US005550432A

United States Patent [19]

Barker

[11] Patent Number: 5,550,432

[45] Date of Patent: Aug. 27, 1996

[54] SMART ADAPTIVE VACUUM ELECTRONICS

[75] Inventor: Robert J. Barker, Fairfax, Va.

[73] Assignee: The United States of America as represented by the Secretary of the Air Force, Washington, D.C.

[21] Appl. No.: 333,151

[22] Filed: Nov. 1, 1994

[51] Int. Cl.[6] ..... H01J 23/04; H01J 23/087

[52] U.S. Cl. ..... 315/5; 315/5.33; 315/5.35; 315/5.39; 315/5.53; 333/17.1; 331/79

[58] Field of Search ..... 315/4, 5, 5.33, 315/5.35, 5.41, 5.53, 5.39; 331/79, 82, 83, 7; 333/17.1

[56] References Cited

U.S. PATENT DOCUMENTS

| | | | |
|---|---|---|---|
| 3,866,077 | 2/1975 | Baker et al. | 331/336 |
| 4,107,617 | 8/1978 | Tran | 315/5.41 X |
| 4,485,349 | 11/1984 | Siegel et al. | 330/3 |
| 4,634,992 | 1/1987 | Brown | 333/17.1 X |
| 4,687,970 | 8/1987 | Musslyn et al. | 315/106 |
| 4,700,146 | 10/1987 | Barton | 331/83 X |
| 4,709,215 | 11/1987 | McClanahan et al. | 330/43 |
| 4,754,239 | 6/1988 | Sedivec | 333/26 |
| 4,789,808 | 12/1988 | Hayashi | 315/4 |
| 4,873,408 | 10/1989 | Smith et al. | 331/86 X |
| 4,933,650 | 6/1990 | Okamoto | 333/99 PL |
| 4,939,331 | 7/1990 | Berggren et al. | 361/91 X |
| 4,992,656 | 2/1991 | Clauser | 250/251 |
| 5,079,484 | 1/1992 | Rambert | 315/173 |
| 5,083,097 | 6/1992 | Bolie | 331/6 |
| 5,099,175 | 3/1992 | Schlueter et al. | 315/4 |
| 5,124,664 | 6/1992 | Cade et al. | 330/45 |
| 5,162,965 | 11/1992 | Milberger et al. | 361/56 |
| 5,208,512 | 5/1993 | Forster et al. | 315/111.41 |

FOREIGN PATENT DOCUMENTS

| | | | |
|---|---|---|---|
| 60945 | 4/1984 | Japan | 315/5.53 |

*Primary Examiner*—Benny T. Lee
*Attorney, Agent, or Firm*—William G. Auton

[57] ABSTRACT

A system which integrates "intelligent" electronic feedback into the structure of vacuum electronic devices whose subcomponents are electronically and/or electro-mechanically adaptive. By "vacuum electronic device," is meant any source of microwave (or millimeter-wave) power generation which is driven by electron beams. Such a device is divided into the following main subsections: an electron emitter, an electron beam shaping & acceleration region, an rf signal input coupler (for amplifiers), an electron-beam drift region, at least one rf/beam interaction region where beam energy is converted to an rf signal, a beam-dump region, and the rf signal output coupler. Some of those subsections are instrumented with electronic sensors. The data collected by those sensors will feed into an "on-board" microcomputer (logic unit subsection 8) which will compare it to "ideal" set of values for those parameters. The microcomputer will then "decide" what if any changes to make to a given set of electrically (or electro-mechanically) adjustable operating conditions in certain subsections of the device, and adjust the rf output signal towards a set of ideal characteristics that are predetermined by users of the system.

4 Claims, 7 Drawing Sheets

SMART ADAPTIVE VACUUM ELECTRONICS

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to vacuum electronic devices, and more specifically the invention pertains to a means for integrating an "intelligent" electronic feedback system into the structure of vacuum electronic devices whose subcomponents are electronically and/or electromechanically adaptive. By "vacuum electronic device," is meant any source of microwave (or millimeter-wave) power generation which is driven by electron beams (e-beams).

Vacuum electronic devices which use an integral energetic electron-beam to generate microwave or millimeter-wave radio frequency (rf) power have been in existence in a wide variety of forms since the 1930s. Up to this time, all known vacuum electronic devices have no ability at all to adapt or modify their own operating characteristics. No such devices are manufactured with any ability to sense either their internal states or their output signals. Nor have such devices ever been equipped with on-board microprocessor "brains" which could process sensed data and "act" upon it.

In short, all vacuum electronics to date can only be characterized as "dumb" and unadaptable. The manufacturers of these devices spend large amounts of time in theoretical analysis, subcomponent testing, "cold testing" (i e., testing the beam/rf interaction cavity in the absence of the electron beam), and a painstaking final assembly process during which all components are fitted into the final device to very exact spatial tolerances. This long and tedious process largely explains the high cost ($20,000–$250,000) associated with the completed device. It is also significant to point out that some aspects of the design and fabrication process can still be characterized as a "black art." Senior, experienced engineers are relied upon to use their intuition to finalize some key design parameters without the benefit of thorough physical analysis or understanding. This naturally leads to variations and uncertainty in the final product based upon the skills of the local design and fabrication teams.

Finally, the inability of the devices to modify their internal spatial configurations and/or their electrical operating characteristics necessarily shortens their "shelf-life" and operating lifetime in stressful environments. Vacuum electronics subjected to prolonged storage before use can degrade through such mechanisms as thermionic cathode "poisoning", permanent magnet weakening, and mechanical warpage of critical subcomponents. A self-adaptive device should be able to compensate for some of these flaws to achieve useful operation. Similarly, some devices, particularly those used for military and space applications, are subjected to extremes of temperature and mechanical stress (G-forces). Such conditions can cause an immediate loss of performance and/or permanent damage to the device. The danger of these consequences taking place could be lessened by giving the device the ability to internally compensate for temperature and mechanical stresses. The task of providing a smart adaptive vacuum electronic system is alleviated to some extent, by the systems disclosed in the following U.S. patents, the disclosures of which are incorporated herein by reference:

U.S. Pat. No. 5,208,512 issued to Forster, et al;
U.S. Pat. No. 5,162,965 issued to Milberger, et al;
U.S. Pat. No. 5,124,664 issued to Cade, et al;
U.S. Pat. No. 5,083,097 issued to Bolie;
U.S. Pat. No. 5,079,484 issued to Rambert;
U.S. Pat. No. 4,992,656 issued to Clauser;
U.S. Pat. No. 4,939,331 issued to Berggren, et al;
U.S. Pat. No. 4,933,650 issued to Okamoto;
U.S. Pat. No. 4,873,408 issued to Smith, et al;
U.S. Pat. No. 4,709,215 issued to McClanahan, et al;
U.S. Pat. No. 4,687,970 issued to Musslyn, et al;
U.S. Pat. No. 4,485,349 issued to Siegel, et al;
U.S. Pat. No. 3,866,077 issued to Baker, et al;
U.S. Pat. No. 4,754,239 issued to Sedivec.

The McClanahan et al '215 patent relates to radar transmitters and discloses an attenuation control circuit and a feedback phase control circuit which command digital and analog phase shifters in a travelling wave tube controller.

The Okamoto '650 patent discloses a microwave plasma production apparatus which incorporates a control system comprising a microcomputer.

The Baker et al '077 patent relates to vacuum electronic devices having a valve which may be used to provide feedback from one portion of the emitted electron beam to control the emission control means and reduce noise emitted by the source.

The Bolie '097 patent provides error control loops for pulsed high-power klystrons which automatically "learn" through analysis of past pulse waveform characteristics to properly set the initial condition for a future pulse. Adaptive memory subsystems are described.

The Siegel et al '349 patent relates to a stabilized klystron-based microwave power amplifier system. This patent discloses a microprocessor means which compares a digital signal of actual output power to digital reference signals representative of a desired reference input power level and generates digital correction signals.

The Cade et al '664 patent shows a klystron-type oscillator device having a feedback capability which causes the device to oscillate.

The Forster et al '512 patent relates to a scanned electron cyclotron resonance plasma source wherein a microprocessor controls the frequency of electromagnetic waves emanating from the source of microwaves such as a klystron or a magnetron.

The Rambert '484 patent refers to feedback means in the voltage regulated supply for microwave tubes.

The Clauser '656 patent relates to rotation, acceleration and gravity sensors using quantum-mechanical, matter-wave interferometry with neutral atoms and molecules. The invention allows for compensation of matter-wave path deflections due to inertial effects by different means such as rotationally mounting each interferometer on gimbals or applying additional potentials that introduce defects, and/or retard, and/or accelerate the matter wave propagation. The applied potentials and/or gimbals can then be controlled by a feedback system that maintains null interferometer fringe shifts. Electron beams are disclosed.

The Musslyn et al '970 patent relates to a digital cathode current control loop for controlling the cathode current of a travelling wave tube amplifier.

The Milberger et al '965 patent relates to use of feedbacks and gate reference resistors for microwave tube transmitters.

The Smith et al '408 patent relates to a magnetron with microprocessor based feedback control in the context of microwave oven use. See also the Berggren et al '331 patent.

While the above-cited references are instructive, a need remains to integrate an intelligent electronic feedback system into the structure of vacuum electronic devices whose subcomponents are electronically and electromechanically adaptive. The present invention is intended to satisfy that need.

SUMMARY OF THE INVENTION

The invention involves the integration of an "intelligent" electronic feedback system into the structure of vacuum electronic devices whose subcomponents are electronically and/or electro-mechanically adaptive. By "vacuum electronic device," is meant any source of microwave (or millimeter-wave) power generation which is driven by electron beams. Such a device may generally be divided into the following seven main subsections: an electron emitter (commonly known as the cathode), an electron beam shaping & acceleration region, an electron-beam drift region, an rf signal input coupler (for amplifiers), at least one rf/beam interaction region where beam energy is converted to an rf signal, a beam-dump region, and the rf signal output coupler. Some, if not all, of those subsections would be instrumented with electronic sensors. The data collected by those sensors will feed into an on-board microcomputer which will compare it to an ideal reference set of values for those parameters. The microcomputer will then "decide" what, if any, changes to make to a given set of electrically (or electromechanically) adjustable operating conditions in certain subsections of the device. Such self-adjustments will permit the maintenance of optimum operating characteristics during the entire life of the device. This ability to self-correct flaws in its makeup caused by manufacturing errors, aging, and/or environmental stress should yield a device with a significantly lengthened useful life with only a modest increase in construction cost.

As described above, the electron beam from the electron emitter is modulated by the rf signal from the rf signal input and produces an amplified rf signal output. The microprocessor samples and compares the rf signal output (from the electronic sensors) with an ideal rf signal and makes electrical or electromechanical adjustments within the structure of the vacuum electronic device in order to make the actual rf signal output equal to the ideal rf signal. Examples of such adjustments are briefly mentioned below.

If an adjustment in phase is needed in the rf signal output, the rf signal path can be lengthened (to retard the phase) or shortened (to advance the phase). This is an example of a mechanical adjustment. The electron beam current can be altered by electrically adjusting the temperature of the thermionic cathode which emits the electron beam (using an electronic heater whose temperature depends upon applied current). This is an example of an electrical adjustment. The central objective of this invention is to impart a degree of intelligence and better performance over a longer useful lifetime. The devices could therefore perform a better service to the community in all applications where conventional vacuum electronics are used today. They would be particularly important for military and space applications where their added reliability could save lives and/or large amounts of money. These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

Figure 1:
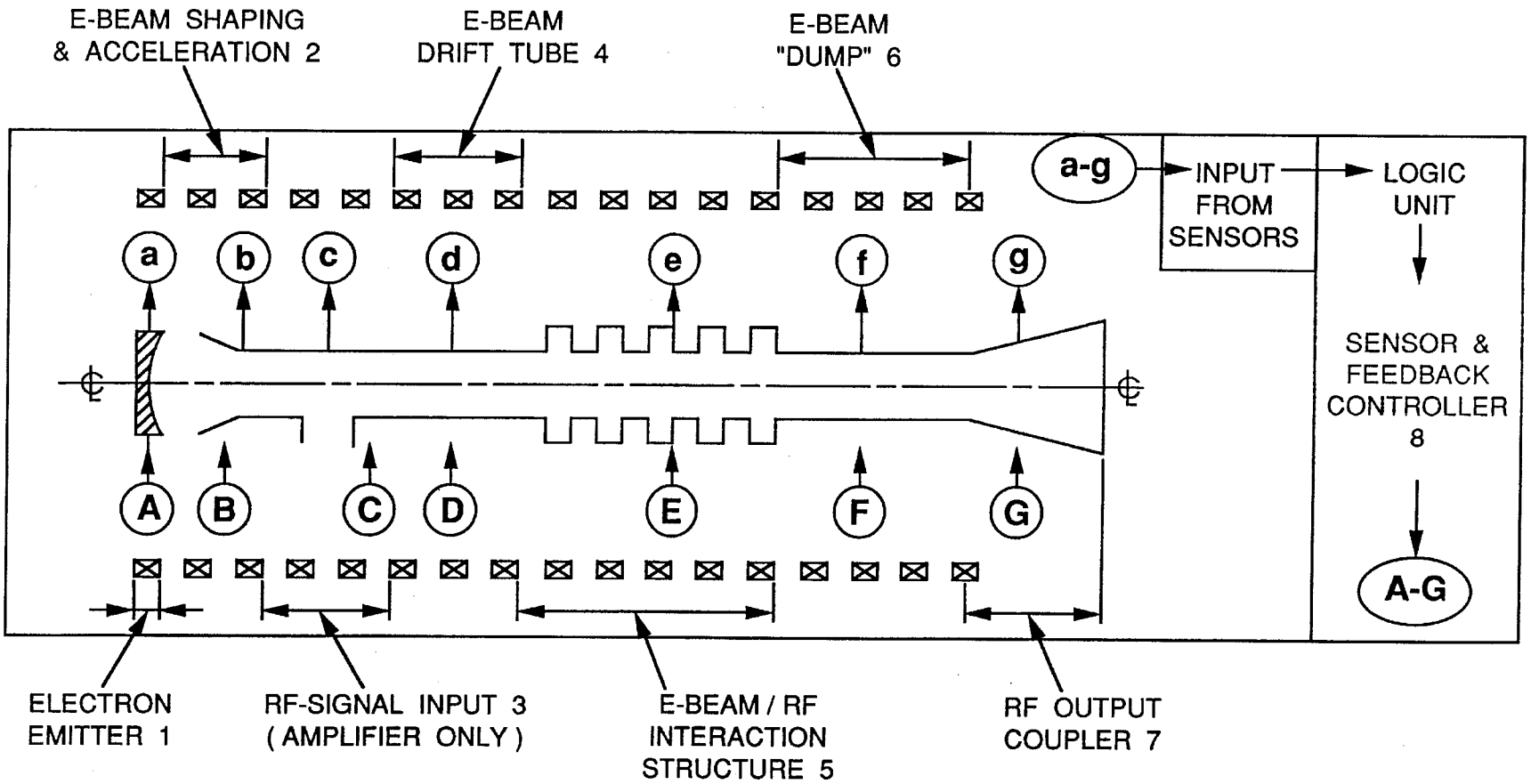
FIG. 1 is a schematic of the preferred embodiment of the present invention.

The present invention is a vacuum electronic system with an intelligent electronic feedback control circuit. An embodiment of this system is illustrated in FIG. 1, and it contains eight main subsections: an electron emitter 1, an electron beam shaping and acceleration region 2, an rf source with an rf signal input coupler 3 (for amplifiers only), an electron-beam drift region 4, at least one rf/beam interaction region 5, where beam energy is converted to an rf signal, a beam-dump region 6, the rf signal output coupler 7, and the sensor and feedback controller 8. Some, if not all of those subsections are instrumented with electronic sensors. The data collected by those sensors will feed into an "on-board" microcomputer which will compare it to an "ideal" set of values for those parameters. The microcomputer will then "decide" what if any changes to make to a given set of electrically (or electro-mechanically) adjustable operating conditions in certain subsections of the device. This ability to self-correct "flaws" in its makeup caused by manufacturing errors, aging, and/or environmental stress should yield a device with a significantly lengthened "useful life" with only a modest increase in construction cost.

The electron emitter 1 of FIG. 1 may be a cathode which produces an electron beam which has an adjustable net current and beam profile. (Subsections 1 and 2, when taken together, are commonly referred to as the "electron gun.") The above-cited Baker patent provides one example of an electron emitter usable in a vacuum electronic device, but a wide variety of alternatives may be suitable.

The electron beam from the electron emitter 1 interacts with the rf wave from the rf source to produce an rf output signal. This is as described in the above-cited Baker et al system because the first seven subsections are characteristic of generic vacuum electronics microwave/millimeter-wave source devices available today. What is new and what characteristizes the substance of this invention are Subsection 8 and the sensor and feedback control systems that link that subsection to the other seven subsections. In FIG. 1, the circled lower-case letters (a,b,c,d,e,f,g) represent sensor data lines which feed information on operating characteristics directly from each of the respective subsections 1 through 7 to the logic unit. Similarly, the circled upper-case letters (A,B,C,D,E,F,G) represent the lines which carry electrical signals from the logic unit (subsection 8) that activate and control electrical and/or electro-mechanical actuators which directly modify some of the physical operating parameters of the respective subsections. Note that for each of the first six subsections, the magnetic field coils (or permanent magnets) which surround a given subsection are considered part of that subsection for sensor and feedback control purposes. For a given device application, it may not be necessary or desirable to place sensor and/or feedback lines into every one of the first seven generic subsections. Laboratory tests on prototype configurations should be used to determine which combination of sensor and feedback lines provides the most benefit for a given device application.

Figure 2B:
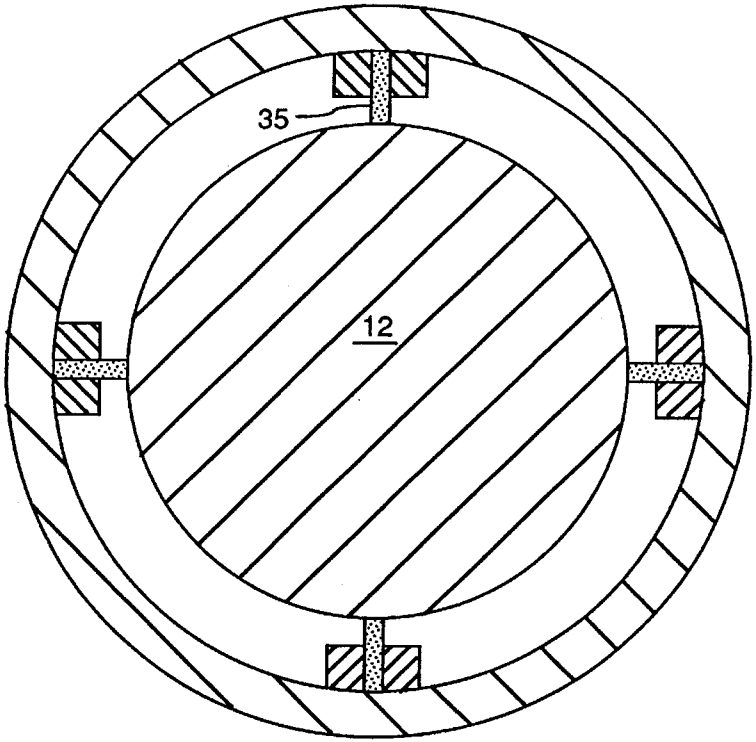
FIG. 2*b* is a sectional end view of a typical thermionic electron beam emitter (cathode)
Figure 2A:
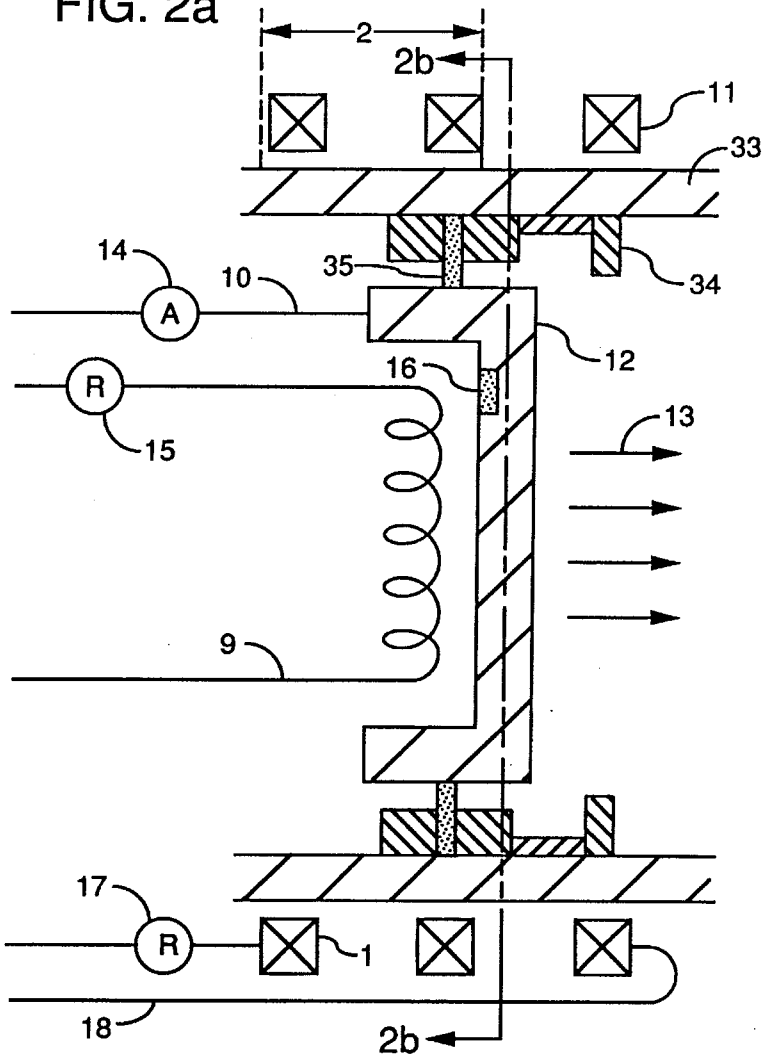
FIG. 2*a* is a sectional side view of a typical thermionic electron beam emitter (cathode)
Figure 3B:
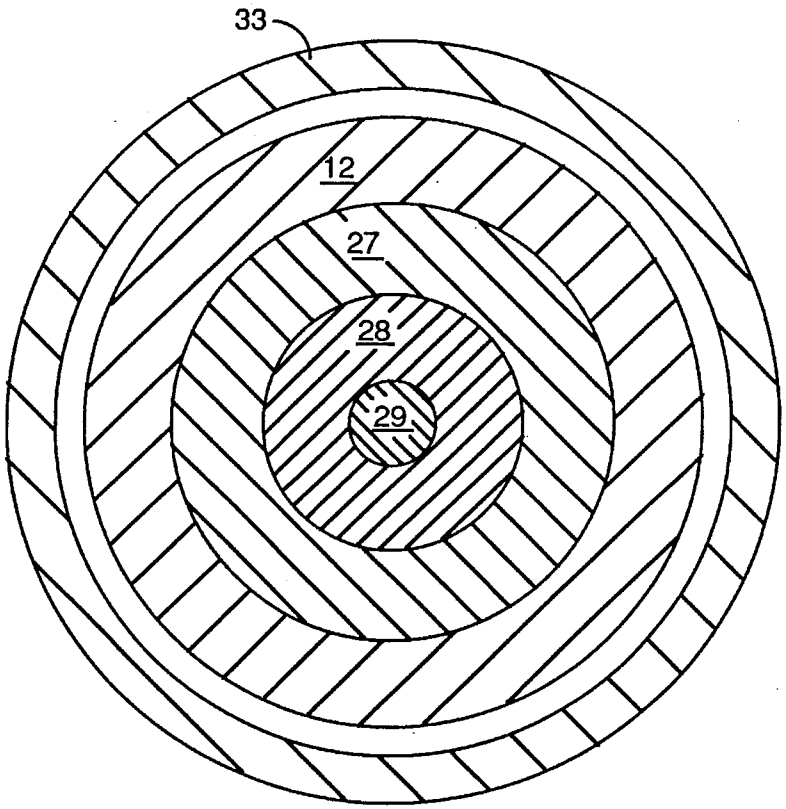
FIG. 3*b* is a sectional end view of a typical segmented thermionic electron beam emitter (cathode)
Figure 3A:
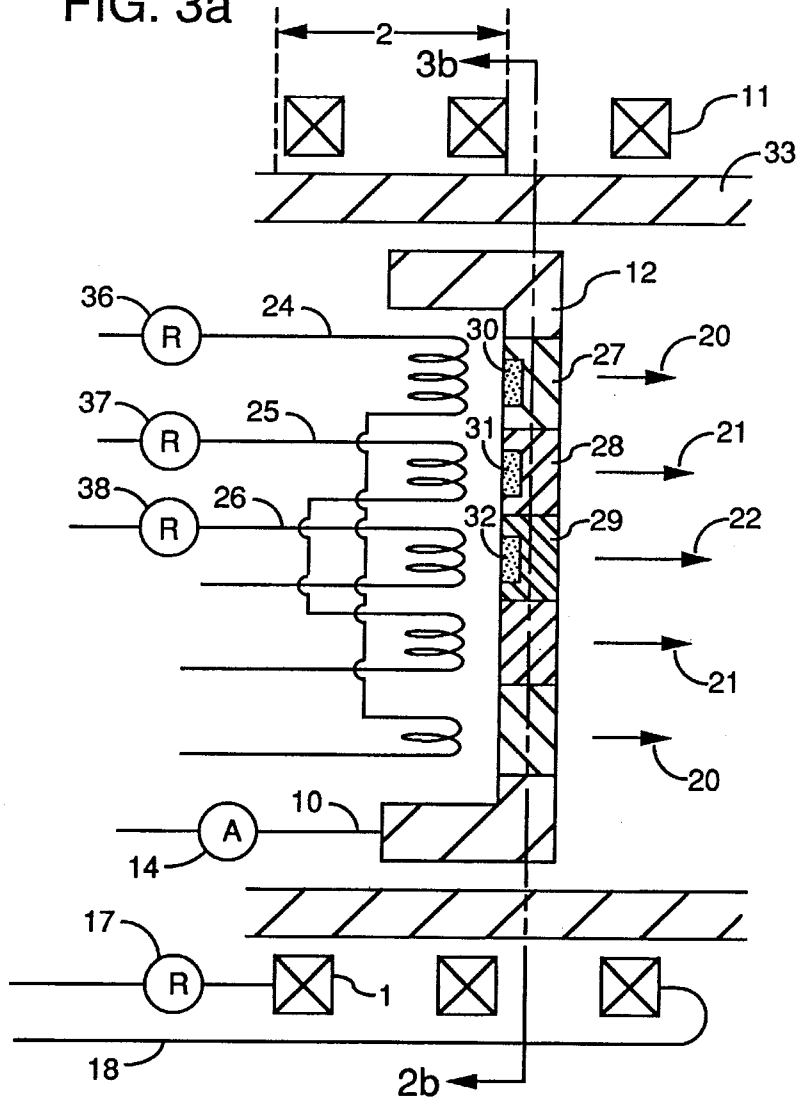
FIG. 3*a* is a sectional side view of a typical segmented thermionic electron beam emitter (cathode)

The following is a description of some of the many sensor and feedback system combinations possible for each of the first seven separate subsections: In a typical vacuum electronics device, the electron emitter 1 will consist of a thermionic cathode and its associated heater mechanism. (A field-emission cathode is a possible alternative for some pulsed, high power or some microelectronic applications.) A typical uniform thermionic cathode assembly is schematically illustrated in FIG. 2*a* and 2*b*. As mentioned above, in all the Figures, like numerals reference like elements. As discussed below, the following elements will appear in the Figures and need not be described in detail since their function is familar to those skilled in the art: the heater filament 9, the logic unit 8, the beam current feed line 10, electromagnets 11, sensor A, and regulator R, low energy beam 13, sensor 14, current regulator 17, electromagnet circuit 18, wall 33, actuators 34 and 35, heat current regulators 36,37,38, and feed lines 72. Electrical current flowing through the heater filament 9 (see FIG. 2*a*) causes its temperature to rise. This, in turn, causes a rise in temperature of the adjacent thermionic cathode 12. As best seen in FIG. 2*a*, the cathode temperature can be monitored by a temperature sensor 16. This temperature, in conjunction with the electrical voltage applied between the cathode and the anode of subsection 2 determines the electrical current of the emitted electron beam 13. That net emitted beam current can be monitored via a current sensor 14 on the beam current feed line 10. Thus, if the logic unit 8 (see FIG. 1) "decides" that the overall device operation would be improved by changing the beam current, then it could instruct the electrical current regulator 15 to accordingly change the supplied heater current and resultant cathode temperature. Similarly, some vacuum electronic devices demonstrate superior performance if their driving electron beam has a nonuniform radial current density profile. This can be achieved by using a segmented thermionic cathode structure such as that schematically illustrated in FIG. 3*a* and 3*b*. The cathode 12 of FIG. 3*a* houses three temperature sensors 30, 31 and 32, that perform as the temperature sensor 16 performs on the cathode 12 of FIG. 2*a*. They provide a reading of cathode temperature that effects the electrical current of the omitted electrode beam. Separate heater filaments 24, 25, & 26 (see FIG. 3*a*) are used to maintain different cathode temperatures on the concentric surfaces 27, 28 & 29. (Here, three segments are illustrated but the number can vary from case to case.) Here again, (in FIG. 3*a*) if the logic unit 8 "decides" that a change in radial beam current density profile (the relative currents carried by emitted concentric beamlets 20, 21, & 22) would improve performance, then it could direct electrical heater current regulators 36, 37, & 38 to appropriately alter their respective supplied currents. Once again, the net beam current can be directly monitored via sensor 14. The relative beamlet currents can only be inferred from theoretical models within the logic unit 8. (If linked to a vacuum pump system connected to the device, this cathode temperature control system could be used to conduct a "bake-out" function.) The strength of the magnetic field (if any) in which the cathode is immersed can be spatially and temporally varied through commands sent to the current regulator 17 (in FIG. 3*a*) on the electromagnet circuit 18 as judged necessary by the logic unit. Cathode position and orientation relative to the device wall 33 can also be sensed and adjusted through electromechanical actuators 34 & 35.

Figure 4:
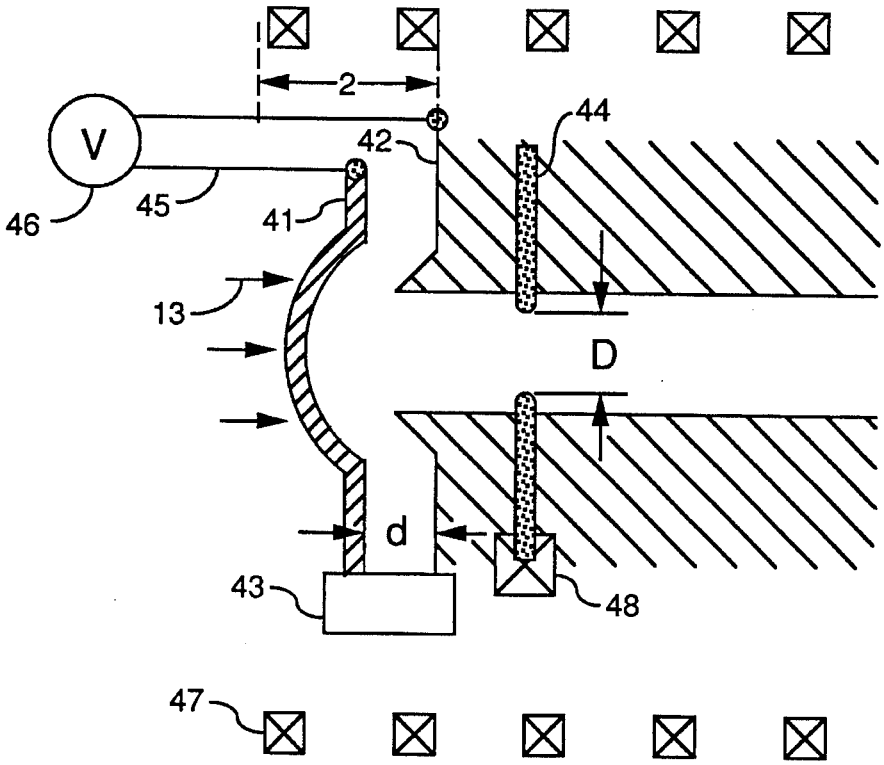
FIG. 4 is a sectional side view of a typical electron beam shaping and acceleration subsection.
Figure 5:
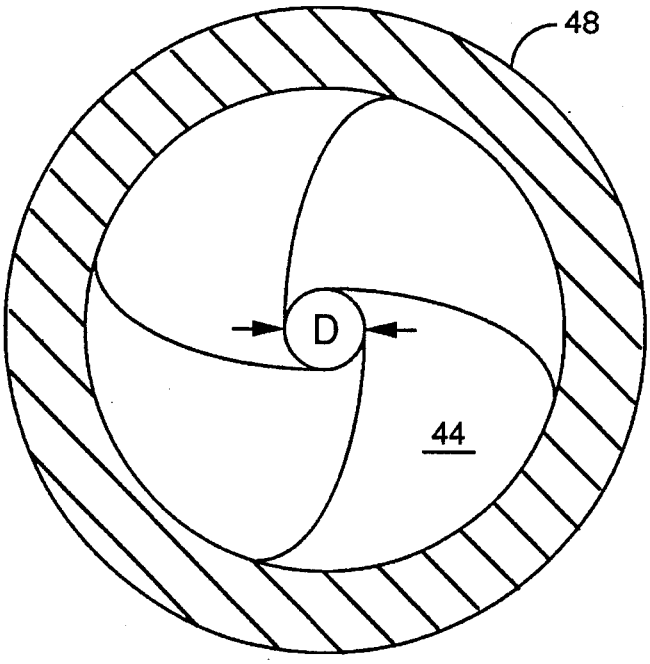
FIG. 5 is a front view of a typical electrically adjustable iris electron beam scrapper.

In a typical vacuum electronic device, once the electron beam is emitted by the cathode, it must then be shaped and accelerated to a desired energy level. This is accomplished in the subsection 2 as schematically illustrated in FIG. 4. (This may also be referred to as the electron "gun" region.) The low energy beam 13 enters from the adjacent cathode surface of subsection 1 through the transparent, conducting grid 41. (Alternatively, this grid may be replaced by an appropriately shaped cathode surface itself.) The electrons are accelerated across the gap of length d, toward the positive anode 42. The acceleration is accomplished by maintaining an electrical potential difference V (or voltage) between the cathode and anode via a voltage source 46 on the anode—cathode circuit 45. The entire subsection is typically immersed in an axial magnetic field, which is normally non-uniform along the axis. If the logic unit 8 "decides" that overall performance would be improved by a differently shaped beam, it could command an electromechanical actuator 43 to change the gap length, d. The shaping, or focus, of the beam could also be modified by commanding changes to the electrical currents which activate the electromagnet segments 47. Such current changes would alter the axial magnetic field strength profile and, thereby, the electron trajectories in the beam. Also, there are device applications which require a carefully collimated electron beam. An iris 44 may be added to "scrape" off the outer radial portion of the electron beam to reduce its diameter to the iris opening size, D. If a segmented leaf iris such as that shown schematically in FIG. 5 is used, its opening, D, can be controlled by the logic unit 8 via an electromechanical servo actuator 48.

Figure 6:
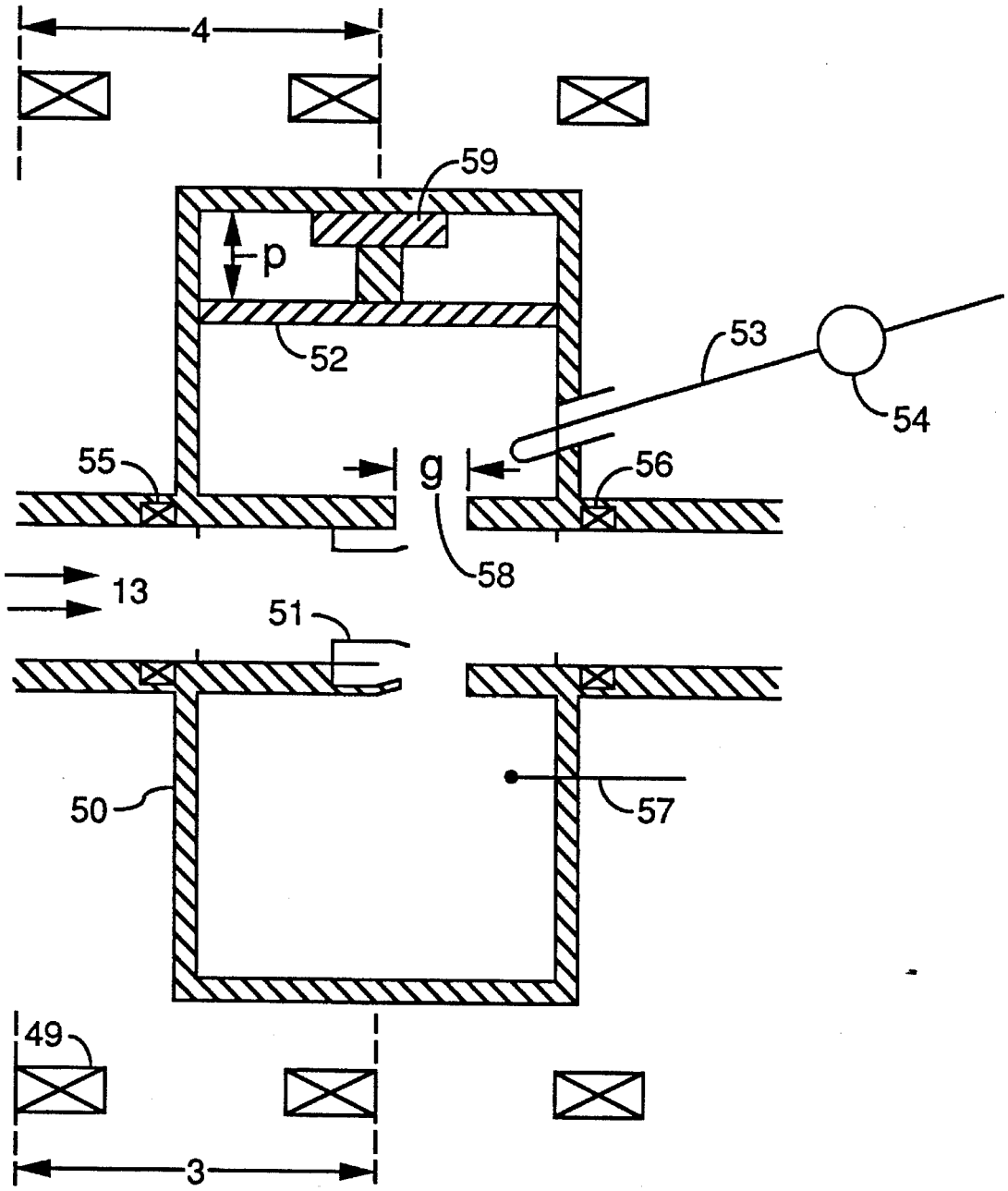
FIG. 6 is a sectional side view of a typical rf-signal input subsection.

A typical schematic rf signal input coupler subsection 3 is depicted in FIG. 6. A klystron-type configuration is chosen here for illustration purposes. In existing, conventional devices, the driving electron-beam 13 from the electron gun (subsections 1 and 2) passes through an input rf coupling cavity 50. Electric fields are excited in the cavity by an rf signal fed in through circuit 53. The electrons in the beam are exposed to the effects of this rf field as they travel past the input cavity gap 58. The rf field causes the beam of electrons to "bunch" thereby creating axial variations in the beam's current density corresponding to the frequency of the rf wave. Many existing devices also have methods, such as plungers 52, for tuning the rf cavity resonance and signal transformers 54 for adjusting the intensity of the input rf signal. A suitable control mechanism is described in the patent application of Helmat Bacher entitled "Coaxial Transmission Line Input Transformer Having Externally Viable Eccentricity and Location." However, to date such adjustment mechanisms are all manually operated and are used only during the manufacturing process. At that time, they are adjusted and permanently set by skilled technicians, never to be changed again during the life of the device. The present invention, on the other hand, would allow for an electromechanical actuator 59 to operate the cavity resonance adjuster 52 under the direction of the logic unit 8. Also, the logic unit 8 would control adjustments to the rf input intensity via the electrical transformer 54. A further degree of control may be imparted by including an electromechanically actuated, axially moveable sleeve (or sleeves) 51 with which the logic unit 8 could control the gap width, g. Electrical adjustments could also be commanded for the axial magnetic field strength imparted by the electromagnetic coils 49. To complement the control suite for the subsection, at least three sensors would be particularly useful. An electric field sensor probe 57 could be inserted into the input cavity to inform the logic unit 8 about the rf field intensity there. A Rogowski coil 55 could monitor the upstream current carried by the electron beam 13, while a similar coil 56 downstream would monitor the beam current there and give information regarding beam current modulation. The logic unit 8 could compare the current values provided by sensors 55 and 56 to determine if there are any beam losses (e.g., due to interception by the device structure) while in transit through this subsection.

In the drift tube subsection 4 in FIG. 1 which is present on many existing vacuum electronic amplifiers, the density bunching of the beam is allowed to grow. Under this invention, one may wish to insert a downstream Rogowski coil current sensor such as 56 in FIG. 6 to keep track of possible beam losses in the subsection and to monitor the density modulation growth. There could also be added electrical control over the current supplied to the electromagnets which generate the axial magnetic field.

Figure 7B:
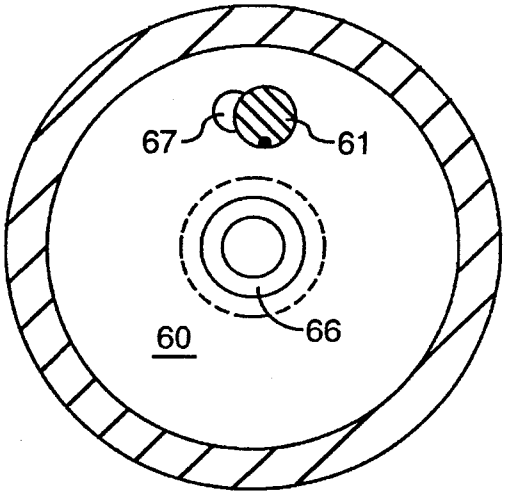
FIG. 7*b* is a sectional end view of a typical apertured disk of the e-beam/rf interaction structure depicted in FIG. 7*a*.
Figure 7A:
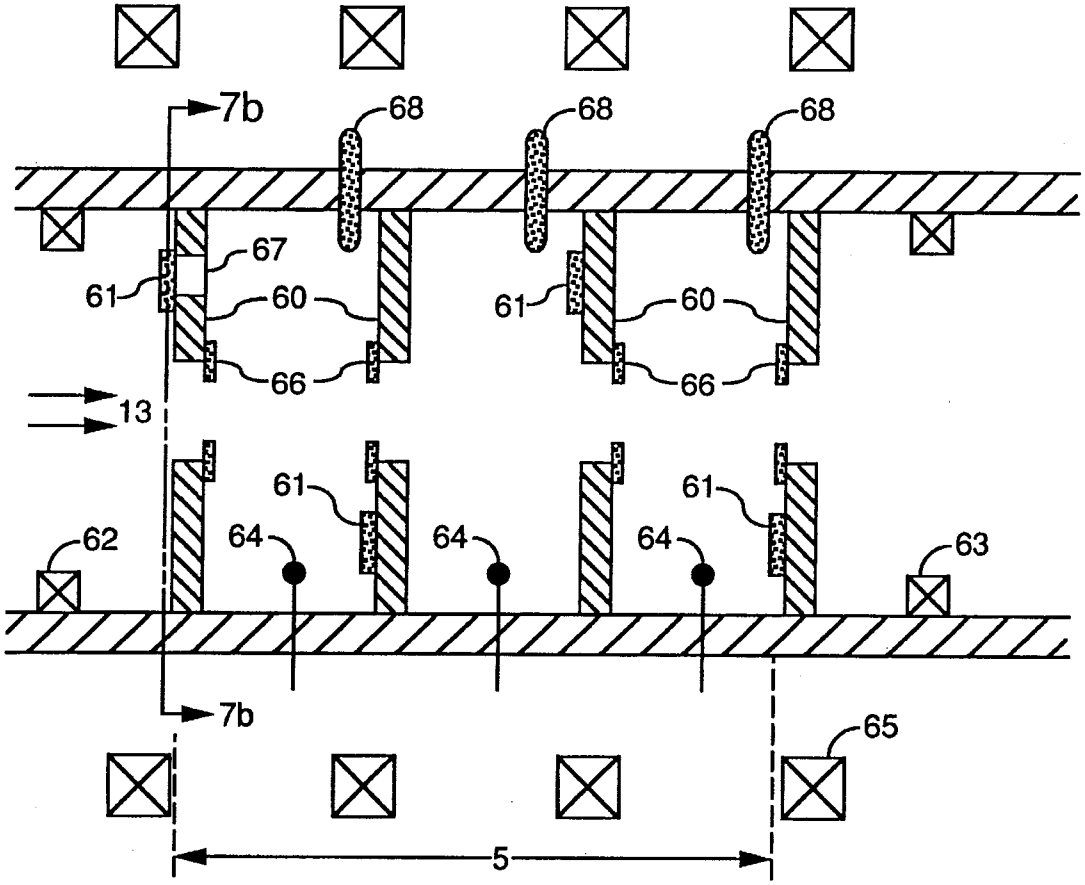
FIG. 7*a* is a sectional side view of a typical e-beam/rf interaction structure subsection.

The e-beam/rf interaction subsection 5 of existing vacuum electronic devices varies widely in structure from device to device. Its primary purpose is to slow the growing rf output signal's valocity to match that of the driving e-beam so that energy may be coupled out of the beam and into the rf wave. FIGS. 7*a* and 7*b* schematically illustrate an example of such an interaction region ("slow wave structure") which might be found in a traveling-wave tube. As in existing devices, this new invention (as shown in FIG. 7*a*) has the electron-beam 13 traveling down the axis of the structure. Guided by the magnetic field generated by the electromagnet coils 65, it penetrates through the apertured disks 60 to exchange energy with the rf signal in each of the resonant cavities. The rf energy, in turn, couples from cavity to cavity via off-axis coupling holes 67. To that existing arrangement, this invention (as shown in FIG. 7*a*) adds the possibility of electric field probes 64 which would feed information about the cavity rf fields to the logic unit 8, as well as Rogowski coils 62 and 63 which sense the e-beam current values upstream and downstream of subsection 5, respectively. Comparing the two beam current values will provide information about possible beam losses in that subsection. Furthermore, acting on the totality of the sensor information, the logic unit 8 could electrically modify the magnetic field profile by adjusting the current flowing to the electromagnets 65. It could also widen or narrow the axial beam aperture through each of the disks 60 via electrically actuated irises 66. Furthermore, the cavity-to-cavity rf signal coupling could be adjusted via electrically controlled shutters 61. Finally, the individual rf resonance characteristics of the cavities could be adjusted by logic unit 8 via electrically actuated tuning slugs 68 (see FIG. 7*a*).

In existing vacuum electronic devices, the relative positions of the e-beam dump subsection 6 and the rf output coupler subsection 7 of FIG. 1 may be reversed depending upon the rf extraction geometry. If the rf output exits the device axially, as shown in FIG. 1, then the electron-beam is normally deflected off-axis and captured in a beam-dump subsection before it can hit the rf extraction "window" in subsection 7. On the other hand, if the rf signal is extracted radially, then the axial trajectory of the e-beam will not intersect the rf extraction "window" so that it does not matter if the e-beam is "dumped" before or after the rf output subsection.

Figure 8:
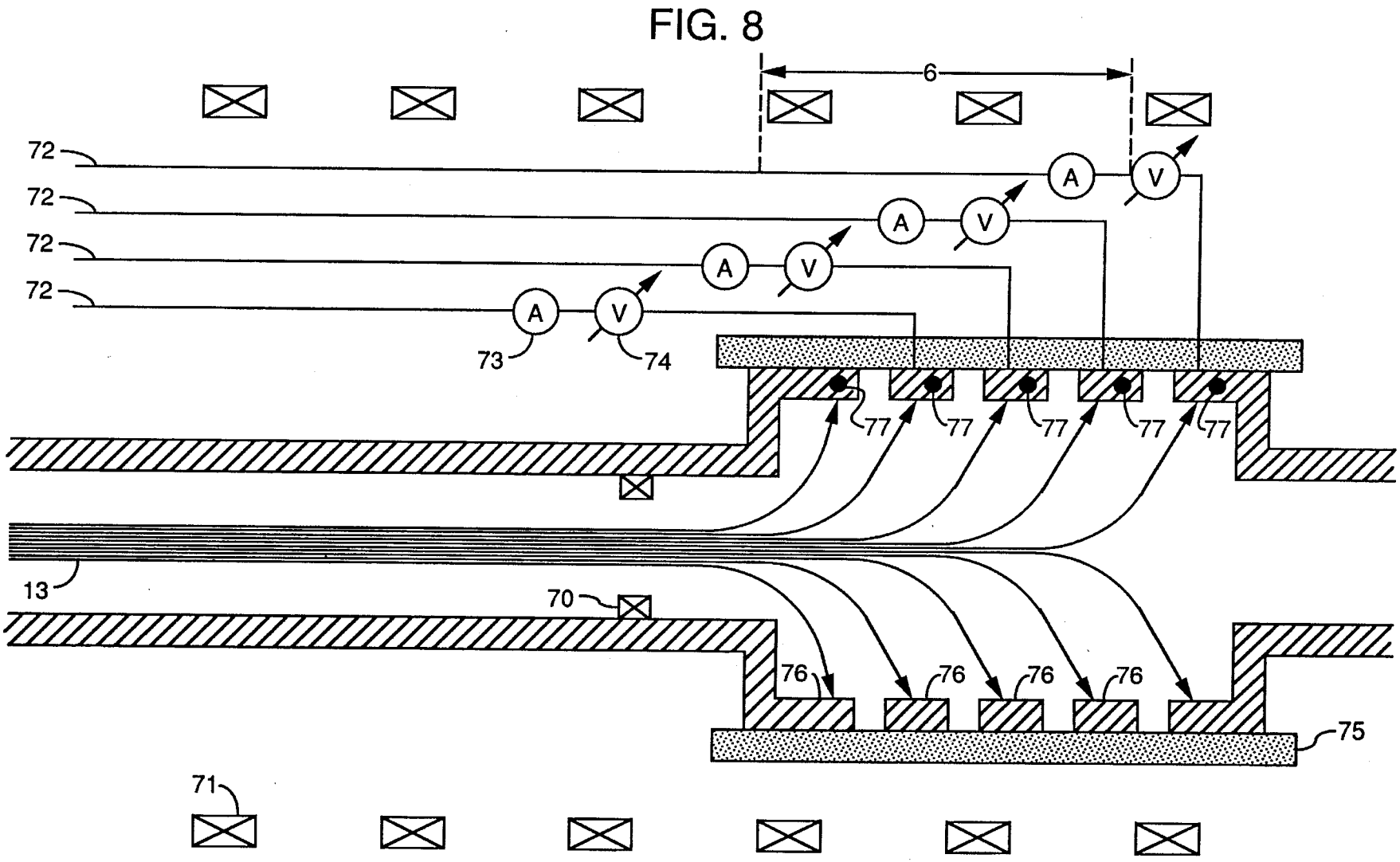
FIG. 8 is a sectional side view of a typical electron beam "dump" subsection.

FIG. 8 schematically illustrates a typical e-beam "dump" subsection 6 for a vacuum electronic device with axial rf output extraction. In existing devices, the electron beam 13 enters this subsection after much of its available energy has been extracted and converted to rf energy. At this point, the e-beam is no longer useful for the purposes of rf power generation and must simply be "disposed of" as efficiently as possible. Existing devices typically accomplish this by simply progressively weakening the axial magnetic field strength by increasing the inter-coil spacing of the electromagnets 71. This allows the e-beam to radially "explode" due to its internal space-charge repulsion. The diffuse beam then strikes the outer wall 76 where its electrons and their residual kinetic energy are collected. Most of the residual kinetic energy is directly converted to heat in the wall which must be dissipated through some cooling subsystem 75. In addition, a subsystem known as a "depressed collector" may be incorporated into the beam-dump subsection 6. The purpose of a depressed collector is to recapture a portion of the otherwise wasted kinetic energy of the e-beam through a controlled axial deceleration process. In this new invention, sensors could here monitor e-beam current via Rogowski coil 70, magnetic field profile, wall surface temperature via sensors 77, and depressed collector voltage(s) 74 and current(s) 73 as a function of position and time. Feedback control could modify the magnetic field profile, cooling assist subsystems 75, and depressed collector voltage limits.

In FIG. 7 the rf output coupler subsection 7 the desired rf signal is extracted from the device. This subsection typically can closely resemble the rf input subsection 3 as depicted in FIG. 6. Of critical concern here is a proper matching of impedance between the device and the attached transmission line 53 or antenna system which immediately follows it. Impedance mismatch could cause undesirable reflections which will reduce the output power level. Also of interest is the electromagnetic field pattern in this subsection since it will determine the pattern of the radiated rf power. Electric field sensors 57 here should probably be augmented with a similar sensor 54 connected to the recipient system (transmission line 53 or antenna) in order to monitor unwanted signal reflections. Wall and output window temperature monitors could ensure that no significant portion of the unspent e-beam is impacting this subsection. Feedback control could be supplied to an impedance-matching subsystem mechanism.

In addition to the above-mentioned sensor and feedback systems associated with specific subsections of the device, it would also be reasonable to incorporate several global systems into the overall device. For example, an accelerometer could be present in the device to monitor severe mechanical stress (g-forces). Likewise, a temperature sensor on the outer metal case of the device could monitor the general thermal environment which acts on the entire device. A pressure sensor could be included to monitor the integrity of the device's internal vacuum. Also, a laser optical system could provide a single reference frame for subsection position and orientation measurements. All of these global systems would likewise feed information into and be controlled by the logic unit subsection 8 as described below.

The on-board Microcomputer Control Unit (or "logic Unit") subsection 8 is the heart of this invention. It receives digitized data input from all of the sensors located throughout the other subsections of the device. It continuously or periodically compares this observed data to preprogrammed limits of "acceptable" values for this same data which it holds in its computer memory. When any sensed values deviate beyond present bounds from these "acceptable" values, it will use the feedback lines to electrically or electromechanically initiate corrective actions in one, some, or all of the control subsystems. It is important to note that sensed "flaws" in one subsection may trigger corrective actions in any of the other subsections depending upon the programmed solutions that have been entered into the memory of the logic unit.

The major advantages offered by this invention over the old type of vacuum electronics devices have already been described in the sections above. First of all, a device which can sense, diagnose, and correct its own operational parameter flaws can be manufactured to less stringent tolerances, thus, saving fabrication costs. It can "fine tune" itself. Second, such an adaptive device can be expected to have a longer "shelf life" since it will self-compensate for some types of thermal and mechanical aging processes that may have degraded its subsystems. Thirdly, it should have a higher probability for successful operation under demanding short-term conditions of severe mechanical and/or thermal stress (such as can likely occur in military systems). Finally, its overall useful lifetime as compared to its "dumb" counterparts should be longer, due to its continuing self-optimization process.

The new features in this innovative new class of vacuum electronics devices are as follows:

1) A suite of electronic sensors (as described in the above sections which monitor the detailed operating characteristics of the device, 2) A feedback suite of electrical and/or electromechanical actuators and feedback control systems which can actively modify selected aspects of the device's operating characteristics (also as described above) on demand, and 3) An on-board microprocessor-based control (or logic) unit which receives all the data from the sensor suite, compares that data to desired operating parameters stored in its memory, and selectively activates predetermined portions of the feedback actuator and control suite to correct for detected "flaws."

There are literally millions of different combinations of sensors and feedback control systems that could be incorporated into any specific Smart Adaptive Vacuum Electronics device. Each and every combination is considered to be covered by this invention.

There are also widely different levels of sophistication which could be incorporated into the data reduction, data analysis, and corrective control procedures which must be programmed into the on-board logic unit. At perhaps the lower level (as described above) actual sensor data is compared to memorized desired parameter ranges and "cookbook" feedback system corrections are ordered—either continuously or on some fixed periodic basis. At a somewhat higher level of sophistication, each newly manufactured device can be placed on a specifically-made, computer-assisted "test stand" which will assist the on-board logic unit to conduct a thorough series of self-tests to judge that particular device's operating characteristics over the entire matrix of possible operating parameters. In this manner, the logic unit will achieve a unique "self-awareness" of its own individual device's optimum operating profile.

At an even higher level of sophistication (but not beyond the capabilities of microcomputer hardware to be expected before the turn of the century), a library of modeling and simulation software for some or all of the major device subsystems could be stored within the logic unit. The unit could then "muse" about ways to improve its device operation in response to a near-infinite variety of specific operating parameters.

In a slightly different vein, it would seem wise to equip such smart devices with some mechanism to, in effect, "ask for help" from the outside world. When the logic unit's sensors detect unselfcorrectable operating conditions which could lead to its demise, it could be provided with a means to shut itself off for self-protection. When any operating flaws are detected which are beyond the capabilities of the feedback control systems to compensate for, some means (electrical, optical, or acoustic) should exist on-board to request intervention by repair personnel. All such features make for a more cost-effective product.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A controlled vacuum electronic device which modulates an externally applied electron beam with an externally applied rf carrier signal and comprising:

a means for modulating that uses said rf carrier signal to modulate said electron beam to produce thereby an rf output signal;

a waveguide housing which receives and conducts said electron beam and said rf output signal from said modulating means;

a means for injecting said electron beam into said waveguide housing with a predetermined beam energy so that said beam energy adjustably amplifies said rf carrier signal;

a means for detecting the rf output signal in the waveguide housing to produce thereby output signals indicating amplitude, phase and frequency of actual characteristics of the rf output signal;

a microprocessor which has an internal memory and which receives and compares the output signals of said detecting means with a corresponding set of desired amplitude, phase and frequency characteristics to produce thereby a set of control signals;

a set of servomechanisms which receive said set of control signals from said microprocessor and which adjust said injecting means in response to said set of control signals;

wherein said injecting means has a cathode which is powered by an electrical input signal with adjustable amplitude, phase and frequency, and which emits said electron beam with adjustable power levels, frequency and phase that varies with the cathode electrical input signal and wherein said servomechanisms includes a means for adjusting the temperature of said cathode which is attached to said cathode to adjust thereby said power levels of said electron beam by thermally affecting impedance to said electrical input signal of said cathode.

2. A controlled vacuum electronics device, as defined in claim 1, wherein said detecting means comprises a set of sensors which are fixed within selected parts of said waveguide housing to detect thereby temperatures of said cathode and said rf output signal, said sensors being electrically connected with said adjusting means to send said output signals of said detecting means thereto.

3. A controlled vacuum electronic device, as defined in claim 1, wherein said set of servomechanisms comprises a set of electrically and mechanically adjustable electromagnets which are fixed adjacent to said waveguide housing and which generate a magnetic field to shape and accelerate said electron beam, wherein said set of electromagnets is electrically connected to said adjusting means, to be controlled thereby.

4. A controlled vacuum electronic device, as defined in claim 3, wherein said servomechanisms can include a set of electromechanically adjustable irises through which said electron beam passes, said adjustable irises having a respective diameter that is controlled by said adjusting means.

* * * * *